United States Patent [19]

Agge et al.

[11] 4,133,251

[45] Jan. 9, 1979

[54] SINGLE LEVER CONTROL APPARATUS

[75] Inventors: Richard W. Agge, Decatur; Kenneth W. Kelly, Warrensburg, both of Ill.

[73] Assignee: Caterpillar Tractor Co., Peoria, Ill.

[21] Appl. No.: 772,399

[22] Filed: Feb. 28, 1977

[51] Int. Cl.[2] ..... F16K 11/18; G05G 9/04

[52] U.S. Cl. ..... 91/521; 137/636.2; 74/471 XY

[58] Field of Search ..... 74/471 XY, 471 R, 519, 74/521; 137/636.2, 636.3, 636.4, 636; 91/413

[56] References Cited

U.S. PATENT DOCUMENTS

| | | | |
|---|---|---|---|
| 3,056,867 | 10/1962 | Eitel | 74/471 XY |
| 3,266,523 | 8/1966 | Stevens | 74/471 XY |
| 3,517,568 | 6/1970 | Payerle | 74/471 XY |
| 3,537,246 | 11/1970 | Pool et al. | 74/471 XY |
| 3,585,319 | 6/1971 | Payerle | 74/471 XY |
| 3,800,615 | 4/1974 | Pilch | 74/471 XY |
| 3,897,805 | 8/1975 | Casey | 137/636.2 X |

*Primary Examiner*—J. M. Meister
*Attorney, Agent, or Firm*—John L. James

[57] ABSTRACT

Control apparatus is provided for a mechanism which has first, second and third work elements each movable between a first position at which the work element is fully retracted and a second position at which the work element is fully extended. The control apparatus includes a single lever device for controllably moving one of the work elements between the first and second positions while maintaining the other work elements in preselected positions in response to controllably directing a pressurized fluid.

17 Claims, 6 Drawing Figures

SINGLE LEVER CONTROL APPARATUS

BACKGROUND OF THE INVENTION

Many mechanisms, such as tractor scrapers, employ fluid actuated work elements such as scraper bowls, aprons and ejectors, for example. Each work element has an operator control for controlling movement of the work element. Where there are three work elements, as on a tractor scraper, there are three operator controls. The controls should be spaced and positioned in a logical, functional order, but there is often insufficient space available to accommodate the most logical and functional layout of the controls. Space is also a problem because of numerous conduits connecting the work elements with the controls.

The present invention is directed to overcoming one or more of the problems as set forth above.

According to the present invention, control apparatus is provided for a mechanism which has first, second and third work elements each movable between a first position at which the work element is fully retracted and a second position at which the work element is fully extended. The control apparatus includes a single lever device for controllably moving a selected one of the work elements between the first and second positions while maintaining the other work elements in preselected positions by directing a pressurized fluid in response to movement of the single lever device.

DETAILED DESCRIPTION OF THE INVENTION

Figure 1:
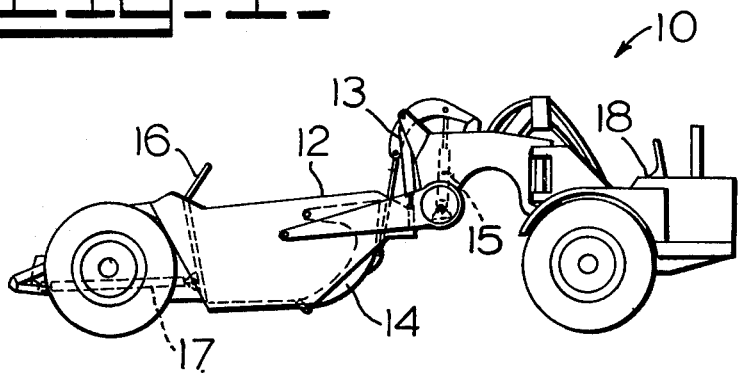
FIG. 1 is a side view of a tractor scraper.

Referring to FIG. 1, a mechanism, such as a tractor-scraper 10 for example, has three work elements, namely, a scraper bowl 12, apron 14 and ejector 16. Each of the work elements 12, 14, 16 is movable between a first position at which the work element 12, 14, 16 is fully retracted and a second position at which the work element 12, 14, 16 is fully extended. The work elements 12, 14, 16 are preferably actuated by fluid devices such as a bowl lift cylinder 13, apron lift cylinder 15 and ejector cylinder 17, respectively, and are controlled by a single lever control 18.

Figure 2:
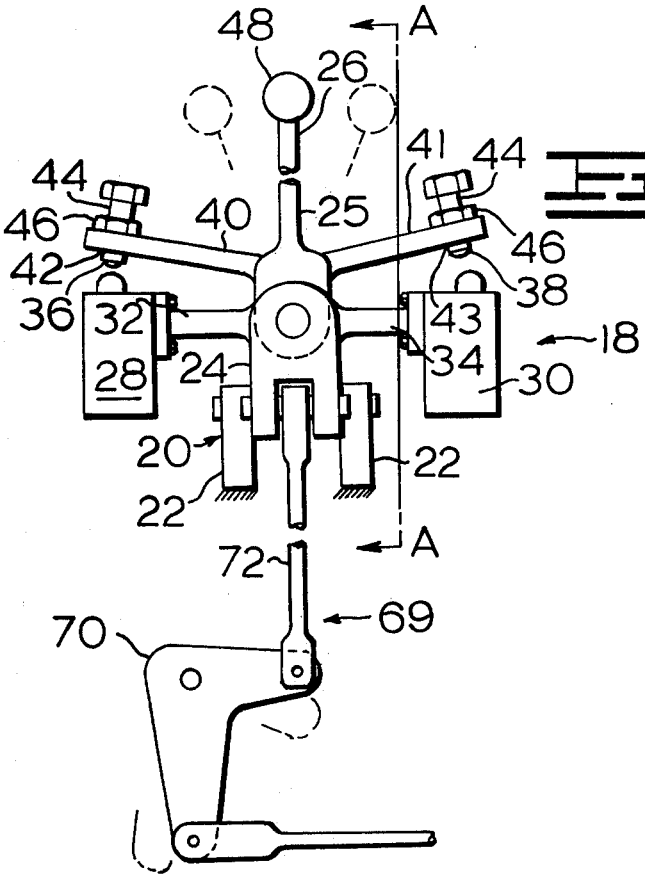
FIG. 2 is a side view of a control lever.
Figure 3:
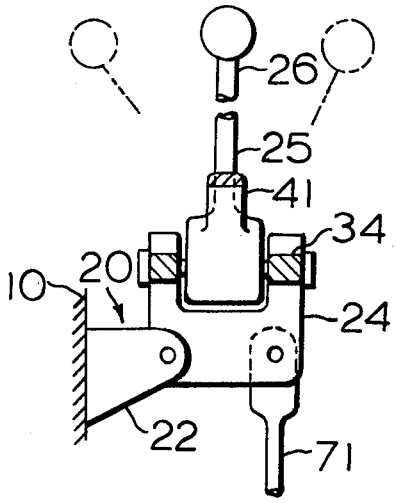
FIG. 3 is a sectional view taken along the line A-A of FIG. 2.

Referring to FIGS. 2 and 3, the single lever control 18 includes a base 20 which has a fixed portion 22 mounted on the scraper 10, a movable portion 24 hinged to the fixed portion 22, and a first end 25 of a lever 26 hinged to the movable portion 24. First and second valves 28, 30 are removably mounted preferably on the movable portion 24 of the base 20. As used herein the term "valve" refers to any device by which the flow of material may be started, stopped, rerouted or regulated by a movable part that opens, closes or partially obstructs the passageway through which the material flows and includes an electrical switch which is a device for making, breaking or changing the connections in an electrical circuit. The movable portion 24 preferably has first and second protuberances 32, 34 for mounting the respective first and second valves 28, 30. The lever 26 preferably has first and second adjustable contactors 36, 38 on the first end 25 for actuation of the respective first and second valves 28, 30. The contactors 36, 38 are preferably carried on respective first and second protuberances 40, 41 which have threaded openings 42, 43, respectively. The contactors 36, 38 include a threaded pin 44, or the like, mateable with the respective threaded openings 42, 43 releasably held by a lock nut 46 or the like. A second end 48 of the lever 26 is movable laterally in two generally perpendicular directions, north-south and east-west for instance as shown by a slotted gate pattern 49 (FIG. 4-A), to move the contactors 36, 38 and selectively actuate the valves 28, 30. The first valve 28 actuates when the lever 26 moves west, for instance, the second valve 30 actuates when the lever 26 moves east, and neither actuates during north or south movement of the lever 26 or when the lever 26 is in the center position. The lever 26 can also have a hollow construction to accommodate valves, such as first and second push-button valves 50, 52 on the second end 48 (FIG. 5). Where push-button valves 50, 52 are used the lever 26 need only move laterally in one direction.

Figures 4, 4A:
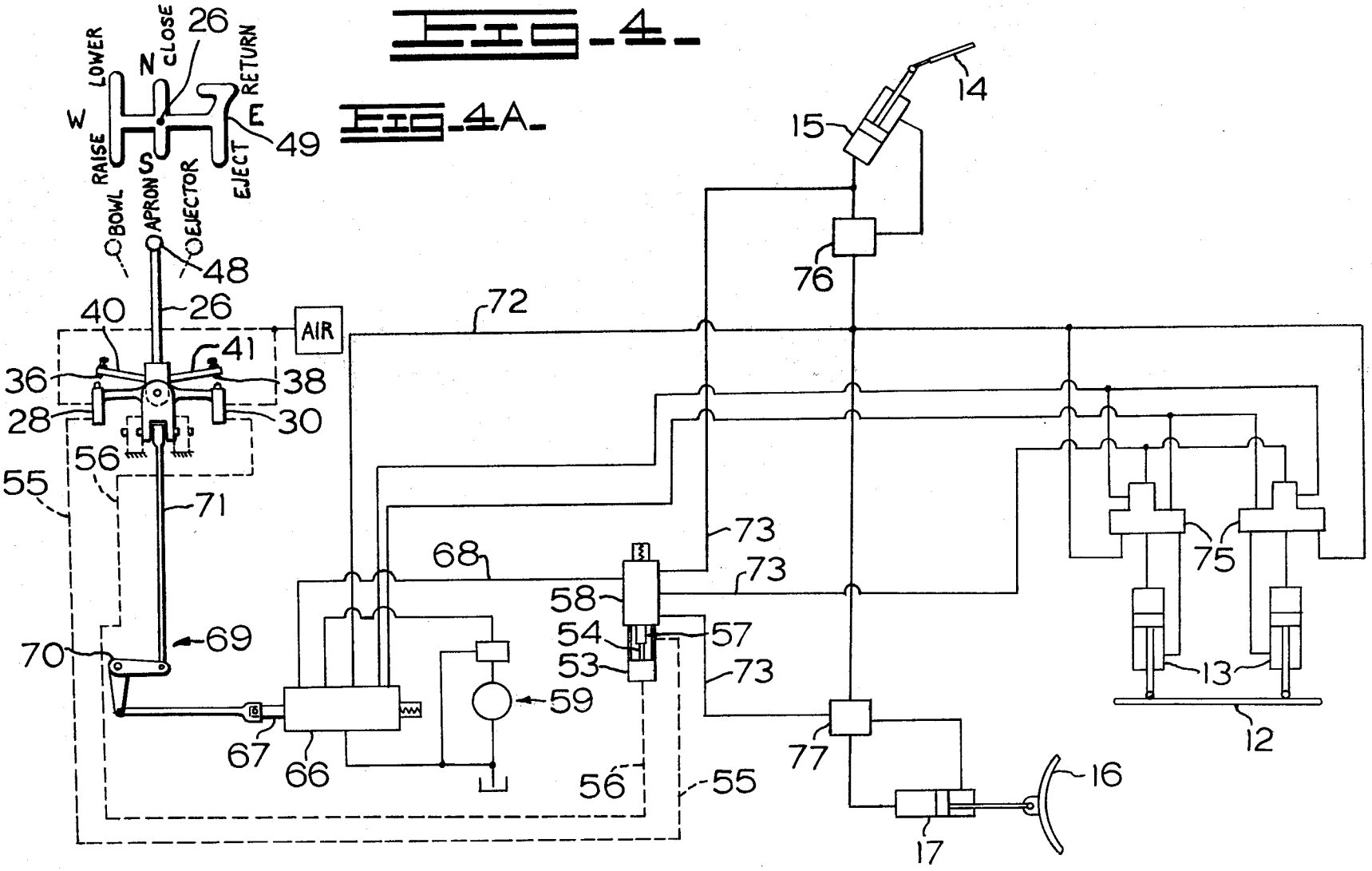
FIG. 4 is a schematic illustration of the present invention.
FIG. 4A is a slotted gate pattern defining movement of the control lever.
Figure 5:
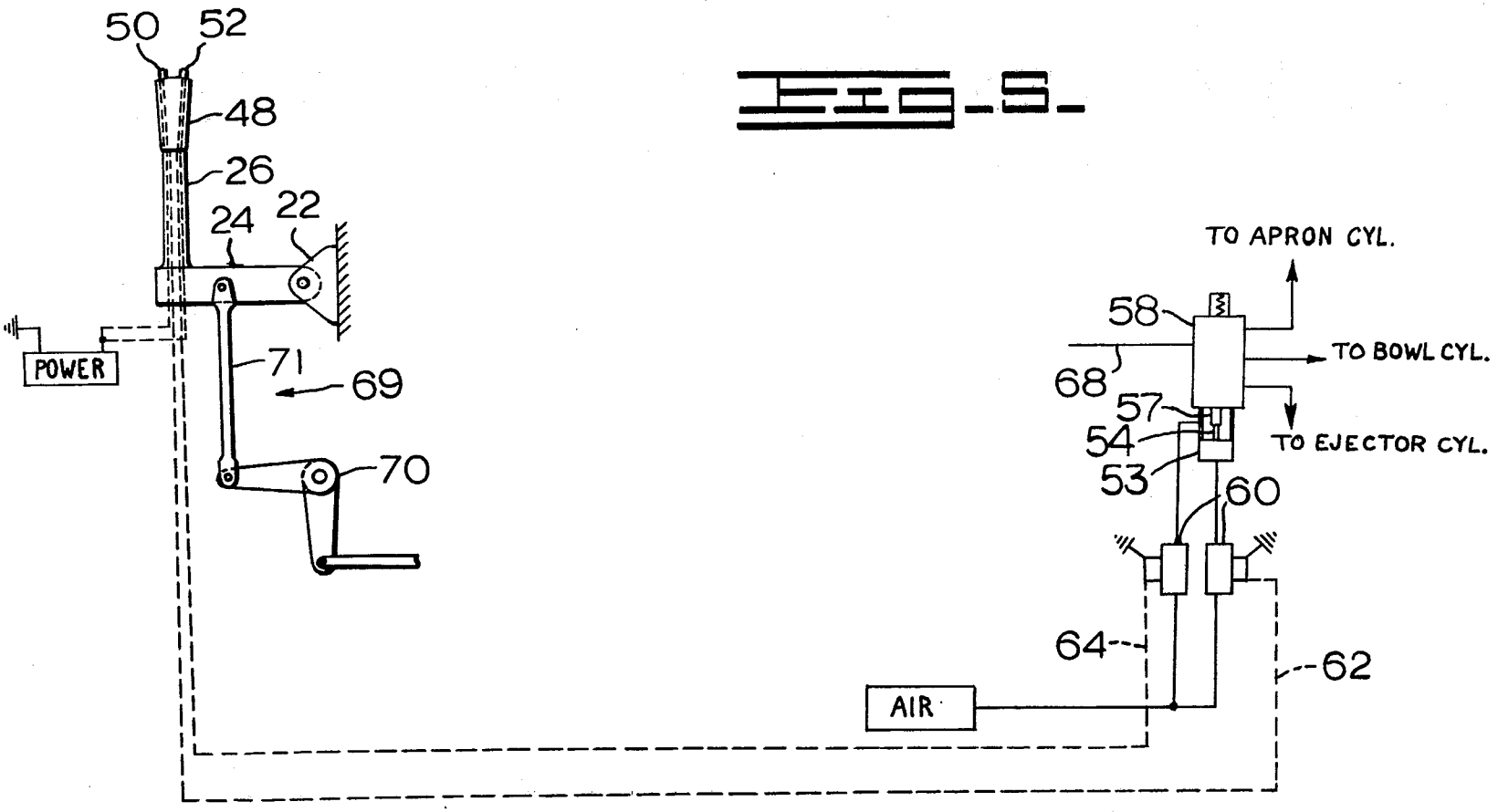
FIG. 5 is a partial schematic illustration similar to FIG. 4.

Referring to FIG. 4, the first and second valves 28, and 30 are preferably connected to a valve actuator, such as a double acting air cylinder 53 which has a plunger 54, by respective first and second conduits 55, 56. The plunger 54 is connected to a stem 57 of a diverter valve 58. The stem 57 is self-centering and selectively connects the diverter valve 58 to one of the work element cylinders 13, 15 and 17. The first and second push-button valves 50, 52 are preferably connected to a solenoid valve 60 and the air cylinder 53 by first and second conductors 62, 64 (FIG. 5). The diverter valve 58 is in fluid communication with a valve, preferably a control valve 66 with a single stem 67, by way of conduit 68. Pressurized fluid is delivered to the control valve 66 by a pump 59 or the like. The control valve 66 is actuated by a linkage mechanism 69 which includes a bell crank 70 connected to the stem 67 and an elongated member 71 connected to the bell crank 70 and pivotally connected to the movable portion 24 of the base 20. the control valve 66 is preferably connected to the work element actuators, namely the scraper bowl lift cylinders 13, apron lift cylinder 15 and ejector cylinder 17, by fluid conduit 72 and by fluid conduit 68, the diverter valve 58 and other conduits 73. Other valves 75, 76 and 77 are connected to the cylinders 13, 15 and 17, respectively to regulate operation of the work elements 12, 14, 16.

In the operation of the single lever control 18, an operator selects the desired work element to be activated, bowl 12, apron 14 or ejector 16 by moving the lever 26 to the desired position as shown on the slotted gating 49. In one direction of movement, east-west for instance, the lever 26 actuates the first or second valves 28, 30 which actuates the air cylinder 53 and diverter valve 58 to operably connect only one of the work elements 12, 16 to the control valve 66 by way of conduit 68. The center or neutral position of the lever 26 operably connects the apron 14 to the control valve 66. In the north-south direction of movement, the lever 26 manipulates the control valve 66 which directs fluid along a path through conduit 72, the work elements 12, 14, 16 and the diverter valve 58 and back to the control valve 66 through conduit 68 or along a path to the diverter valve 58 and then to the desired work element 12, 14, 16. This moves the desired work element 12, 14, 16 towards the first or second position.

In the operation of the scraper bowl 12, for example, the operator moves the lever 26 west to the bowl position of the slotted gate pattern 49. The lever 26 actuates the first valve 28 which, in turn, actuates the air cylinder 53 and diverter valve 58 to connect the bowl cylinders 13 to the control valve 66. To raise the bowl 12, the operator moves the lever 26 south to the raise position of the gate pattern 49. The lever 26 operates the linkage mechanism 69 and the control valve 66. The control valve 66 directs fluid through conduit 68, diverter valve 58, conduit 73 and valve 75 to one end of the bowl cylinder 13 to raise the bowl 12. The operator moves lever 26 north to the lower position of the gate pattern 49 which operates the linkage mechanism 69 and the control valve 66. The control valve 66 directs fluid through conduit 72 and valve 75 to the other end of the bowl cylinder 13 to lower the bowl 12.

The embodiments of the invention in which an exclusive property or privilege is claimed are defined as follows:

1. In a mechanism of a work vehicle having a fluid circuit and first, second and third fluid actuated work elements each selectively and controllably movable between a first position at which said work element is fully retracted and a second position at which said work element is fully extended, the improvement comprising:

a single lever means for controllably moving a selected one of said work elements between said first and second positions and maintaining the other of said work elements in preselected positions in response to controllably directing a pressurized fluid in the fluid circuit in response to controlled movement of a single lever of said lever means in only two opposed directions.

2. An apparatus, as set forth in claim 1, wherein said lever means comprises a base having a stationary portion and a movable portion hinged to said stationary portion.

3. An apparatus, as set forth in claim 2, wherein said lever comprises an end portion having first and second contactors and being hinged to said movable portion of said base, said lever being movable laterally in a first direction and a second direction, said directions being generally perpendicular one to the other.

4. An apparatus, as set forth in claim 3, including first and second valves being disposed for abutting contact with the respective first and second contactors.

5. An apparatus, as set forth in claim 4, wherein said first and second contactors each comprises a protuberance being of a size and configuration sufficient for abutting contact with the respective first and second valves.

6. An apparatus, as set forth in claim 5, wherein each said protuberance forms an opening having threads therein and wherein said contactors each include a pin having threads mateable with said threads of said opening and being positioned for abutting contact with the respective first and second valves.

7. An apparatus, as set forth in claim 4, wherein said first and second valves are mounted on said movable portion of said base.

8. An apparatus, as set forth in claim 7, wherein said movable portion of said base includes first and second protuberances being of a size and configuration sufficient for mounting said valves.

9. An apparatus, as set forth in claim 8, wherein said protuberances and said movable portion of said base form an integral unit.

10. An apparatus, as set forth in claim 4, including a self-centering diverter valve having a single stem and being in fluid communication with a selected one of said work elements.

11. An apparatus, as set forth in claim 10, including a valve actuator having a plunger and being in communication with said first and second valves, said plunger being connected to said stem of said diverter valve.

12. An apparatus, as set forth in claim 2, including a linking mechanism having an elongated member pivotally connected to said movable portion of said base and a bell crank connected to said elongated member.

13. An apparatus, as set forth in claim 12, including a control valve having a single stem, said stem being connected to said bell crank.

14. An apparatus, as set forth in claim 2, wherein said lever has a first end portion connected to said movable portion of said base and a second end portion having first and second valves mounted thereon.

15. An apparatus, as set forth in claim 1, wherein said mechanism is a scraper.

16. An apparatus, as set forth in claim 1, wherein said mechanism is a tractor.

17. An apparatus, as set forth in claim 1, wherein said is an earthmoving vehicle.

* * * * *